US007878001B2

(12) United States Patent
Ishizaka et al.

(10) Patent No.: US 7,878,001 B2
(45) **Date of Patent: *Feb. 1, 2011**

(54) PREMIXED COMBUSTION BURNER OF GAS TURBINE TECHNICAL FIELD

(75) Inventors: Koichi Ishizaka, Takasago (JP); Eisaku Ito, Takasago (JP); Satoshi Tanimura, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 949 days.

This patent is subject to a terminal disclaimer.

(21) Appl. No.: 11/666,500

(22) PCT Filed: Jun. 2, 2006

(86) PCT No.: PCT/JP2006/311108

§ 371 (c)(1),
(2), (4) Date: Apr. 27, 2007

(87) PCT Pub. No.: WO2006/132153

PCT Pub. Date: Dec. 14, 2006

(65) Prior Publication Data

US 2008/0148736 A1 Jun. 26, 2008

(30) Foreign Application Priority Data

Jun. 6, 2005 (JP) ..... 2005-165189

(51) Int. Cl.
*F02C 1/00* (2006.01)
*F02G 3/00* (2006.01)

(52) U.S. Cl. ..... 60/748; 60/737; 60/746; 431/182

(58) Field of Classification Search ..... 60/737, 60/746, 747, 748; 431/182
See application file for complete search history.

(56) References Cited

U.S. PATENT DOCUMENTS 4,996,837 A 3/1991 Shekleton (Continued)

FOREIGN PATENT DOCUMENTS

DE 69820183 T2 8/2004

(Continued)

OTHER PUBLICATIONS

Germany Office Action dated Jan. 8, 2010, issued in corresponding Germany Patent Application No. 112006000427.1.

(Continued)

*Primary Examiner*—William H Rodríguez
(74) *Attorney, Agent, or Firm*—Westerman, Hattori, Daniels & Adrian, LLP

(57) ABSTRACT

A fuel nozzle 110 having a plurality of swirl vane 130 on an outer peripheral surface thereof is installed within a burner tube 120, with a clearance 121 being provided. Each swirl vane 130 progressively curves from an upstream side toward a downstream side (inclines along a circumferential direction) in order to swirl compressed air A flowing through an air passage 111 to form a swirl air flow a. Here, curvature of each swirl vane 130 is greater on its outer peripheral side than on its inner peripheral side. By suppressing occurrence of an air streamline heading from the inner peripheral side toward the outer peripheral side, therefore, flow velocity on the inner peripheral side and flow velocity on the outer peripheral side become equal, thus preventing flashback on the inner peripheral side.

13 Claims, 10 Drawing Sheets

U.S. PATENT DOCUMENTS

| | | | | |
|---|---|---|---|---|
| 5,511,375 | A * | 4/1996 | Joshi et al. | 60/39.463 |
| 5,533,329 | A | 7/1996 | Ohyama et al. | |
| 5,865,024 | A | 2/1999 | Kress et al. | |
| 6,141,967 | A * | 11/2000 | Angel et al. | 60/737 |
| 6,267,583 | B1 | 7/2001 | Mandai et al. | |
| 6,301,899 | B1 * | 10/2001 | Dean et al. | 60/737 |
| 6,502,399 | B2 * | 1/2003 | Mandai et al. | 60/748 |
| 6,655,145 | B2 | 12/2003 | Boardman | |
| 6,684,641 | B2 | 2/2004 | Moriya et al. | |
| 6,962,055 | B2 | 11/2005 | Chen et al. | |
| 6,968,692 | B2 * | 11/2005 | Chin et al. | 60/737 |
| 6,993,916 | B2 * | 2/2006 | Johnson et al. | 60/776 |
| 7,134,258 | B2 | 11/2006 | Widener | |
| 2001/0023590 | A1 | 9/2001 | Mandai et al. | |
| 2002/0014078 | A1 | 2/2002 | Mandai et al. | |
| 2003/0106321 | A1 | 6/2003 | Von Der Bank | |
| 2007/0028618 | A1 * | 2/2007 | Hsiao et al. | 60/737 |
| 2007/0289305 | A1 * | 12/2007 | Oda et al. | 60/748 |
| 2008/0289341 | A1 * | 11/2008 | Ishizaka et al. | 60/748 |
| 2010/0050647 | A1 * | 3/2010 | Goodwin | 60/748 |

FOREIGN PATENT DOCUMENTS

| | | | |
|---|---|---|---|
| GB | 2252400 | A | 8/1992 |
| JP | 60-99933 | A | 6/1985 |
| JP | 63-104816 | U | 7/1988 |
| JP | 2-100060 | U | 8/1990 |
| JP | 2-503106 | A | 9/1990 |
| JP | 8-135924 | A | 5/1996 |
| JP | 8-210641 | A | 8/1996 |
| JP | 10-185185 | A | 7/1998 |
| JP | 11-14055 | A | 1/1999 |
| JP | 11-83016 | A | 3/1999 |
| JP | 11-337068 | A | 12/1999 |
| JP | 2000-55367 | A | 2/2000 |
| JP | 11-83016 | A | 10/2000 |
| JP | 2001-73804 | A | 3/2001 |
| JP | 2002-31343 | A | 1/2002 |
| JP | 2004-12039 | A | 1/2004 |
| JP | 2005-106411 | A | 4/2005 |

OTHER PUBLICATIONS

International Search Report of PCT/JP2006/311108, date of mailing Sep. 5, 2006.

Japanese Office Action dated Dec. 1, 2009, issued in corresponding Japanese Patent Application No. 2005-165189, Submitted in Japanese language. No English translation was provided.

Chinese Office Action dated Feb. 6, 2009, issued in related Chinese Patent Application No. 200680001290.5.

* cited by examiner

PREMIXED COMBUSTION BURNER OF GAS TURBINE TECHNICAL FIELD

TECHNICAL FIELD

This invention relates to a premixed combustion burner of a gas turbine. The present invention is contrived to be capable of effectively premixing a fuel and air to form a fuel gas of a uniform concentration, and uniformizing the flow velocity of the fuel gas, thereby preventing backfire reliably.

BACKGROUND ART

A gas turbine used in power generation, etc. is composed of a compressor, a combustor, and a turbine as main members. The gas turbine often has a plurality of combustors, and mixes air, which is compressed by the compressor, with a fuel supplied to the combustors, and burns the mixture in each combustor to generate a high temperature combustion gas. This high temperature combustion gas is supplied to the turbine to drive the turbine rotationally.

An example of the combustor of a conventional gas turbine will be described with reference to FIG. 11.

As shown in FIG. 11, a plurality of combustors 10 of the gas turbine are arranged annularly in a combustor casing 11 (only one combustor is shown in FIG. 11). The combustor casing 11 and a gas turbine casing 12 are full of compressed air to form a casing 13. Air, which has been compressed by a compressor, is introduced into this casing 13. The introduced compressed air enters the interior of the combustor 10 through an air inlet 14 provided in an upstream portion of the combustor 10. In the interior of an inner tube 15 of the combustor 10, a fuel supplied from a fuel nozzle 16 and compressed air are mixed and burned. A combustion gas produced by combustion is passed through a transition pipe 17, and supplied toward a turbine room to rotate a turbine rotor.

FIG. 12 is a perspective view showing the fuel nozzle 16, the inner tube 15, and the transition pipe 17 in a separated state. As shown in this drawing, the fuel nozzle 16 has a plurality of premixing fuel nozzles 16*a*, and one pilot fuel nozzle 16*b*. A plurality of swirlers 18 are provided in the inner tube 15. The plurality of premixing fuel nozzles 16*a* penetrate the swirlers 18, and are then inserted into the inner tube 15.

Thus, the fuel injected from the premixing fuel nozzles 16*a* is premixed with air, which has been converted to a swirl flow by the swirlers 18, and is burned within the inner tube 15.

Patent Document 1: Japanese Unexamined Patent Publication No. 1999-14055

Patent Document 2: Japanese Unexamined Patent Publication No. 2004-12039

DISCLOSURE OF THE INVENTION

Problems to be Solved by the Invention

The conventional technology shown in FIG. 12 was a combustion burner of the type having the swirlers 18 provided in the inner tube 15, and having no swirlers (swirler vanes: swirl vanes) provided on the side of the premixing fuel nozzles 16*a*.

The inventor of the present application developed a different type of a combustion burner, which was a premixed combustion burner of a gas turbine, the burner having swirl vanes (swirler vanes) on the outer peripheral surface of a premixing fuel nozzle.

The premixed combustion burner having swirl vanes on the outer peripheral surface of a premixing fuel nozzle has hitherto been present, but there has been no premixed combustion burner with satisfactory performance which can (1) thoroughly mix a fuel to form a fuel gas of a uniform concentration, and (2) uniformize the flow velocity of the fuel gas to prevent backfire reliably.

The inventor diligently conducted studies on a premixed combustion burner having swirl vanes provided on the outer peripheral surface of a premixing fuel nozzle, and developed a premixed combustion burner of a gas turbine having unique features and excellent effects which are absent in conventional technologies. The inventor has decided to file an application for a patent on the results gained.

Means for Solving the Problems

A constitution of the present invention for solving the above problems is a premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and the angle is larger on an outer peripheral side of the rear edge of the swirl vane than the angle on the inner peripheral side of the rear edge of the swirl vane.

Another constitution of the present invention is a premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and is 25 to 35 degrees on an outer peripheral side of the rear edge of the swirl vane.

Another constitution of the present invention is a premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, characterized in that a clearance is provided between an outer peripheral side end surface of the swirl vane and an inner peripheral surface of the burner tube.

Another constitution of the present invention is the premixed combustion burner of a gas turbine according to any one of the above constitutions, characterized in that a clearance is provided between an outer peripheral side end surface of the swirl vane and an inner peripheral surface of the burner tube, and a ratio between a vane height of the swirl vane and a length of the clearance (clearance length/vane height) is set at 1 to 10%.

Another constitution of the present invention is the premixed combustion burner of a gas turbine according to any one of the above constitutions, characterized in that in order to render a clearance between an outer peripheral side end surface of the swirl vane and an inner peripheral surface of the burner tube constant, a clearance setting rib, which makes intimate contact with the inner peripheral surface of the burner tube, is provided at a portion of the outer peripheral side end surface of the swirl vane.

Another constitution of the present invention is the premixed combustion burner of a gas turbine according to any one of the above constitutions, characterized in that an aspect ratio between a vane chord length and the vane height of the swirl vane (vane height/vane chord length) is set at 0.2 to 0.75.

Another constitution of the present invention is the premixed combustion burner of a gas turbine according to any one of the above constitutions, characterized in that a vane thickness of the swirl vane is a length which is 0.1 to 0.3 times a vane chord length of the swirl vane.

Another constitution of the present invention is the premixed combustion burner of a gas turbine according to any one of the above constitutions, characterized in that a vane thickness at the rear edge of the swirl vane is smaller than 0.2 times a throat length.

Another constitution of the present invention is the premixed combustion burner of a gas turbine according to any one of the above constitutions, characterized in that fuel injection holes for injecting a fuel supplied from the fuel nozzle through fuel passages are formed in the swirl vane, and the fuel injection holes formed in opposed vane surfaces of the adjacent swirl vanes are positioned such that positions of the fuel injection holes formed in one of the vane surfaces, and positions of the fuel injection holes formed in the other vane surface are displaced with respect to each other.

Effects of the Invention

According to the present invention, the angle formed by the tangent to the average camber line of the swirl vane at the rear edge of the swirl vane and the axis line extending along the axial direction of the fuel nozzle is 0 to 10 degrees on the inner peripheral side of the rear edge of the swirl vane, and the angle is larger (25 to 35 degrees) on the outer peripheral side of the rear edge of the swirl vane than the angle on the inner peripheral side of the rear edge of the swirl vane. Thus, whether on the inner peripheral side or on the outer peripheral side of the air passage, the flow velocity of air becomes uniform, the occurrence of backfire can be prevented, and the fuel concentration becomes uniform.

According to the present invention, moreover, the clearance is provided between the outer peripheral side end surface of the swirl vane and the inner peripheral surface of the burner tube. Thus, a vortex air flow is produced by the action of a leakage flow, which passes through the clearance and flows from the vane dorsal surface to the vane ventral surface, and a flow in the axial direction, and this vortex air flow can promote the mixing of the fuel and air.

BRIEF DESCRIPTION OF THE DRAWINGS

FIG. 8(*b*) is a characteristic view showing the relationship between the loss and the ratio (clearance length/vane length).

DESCRIPTION OF THE NUMERALS AND SYMBOLS

Figure 1:
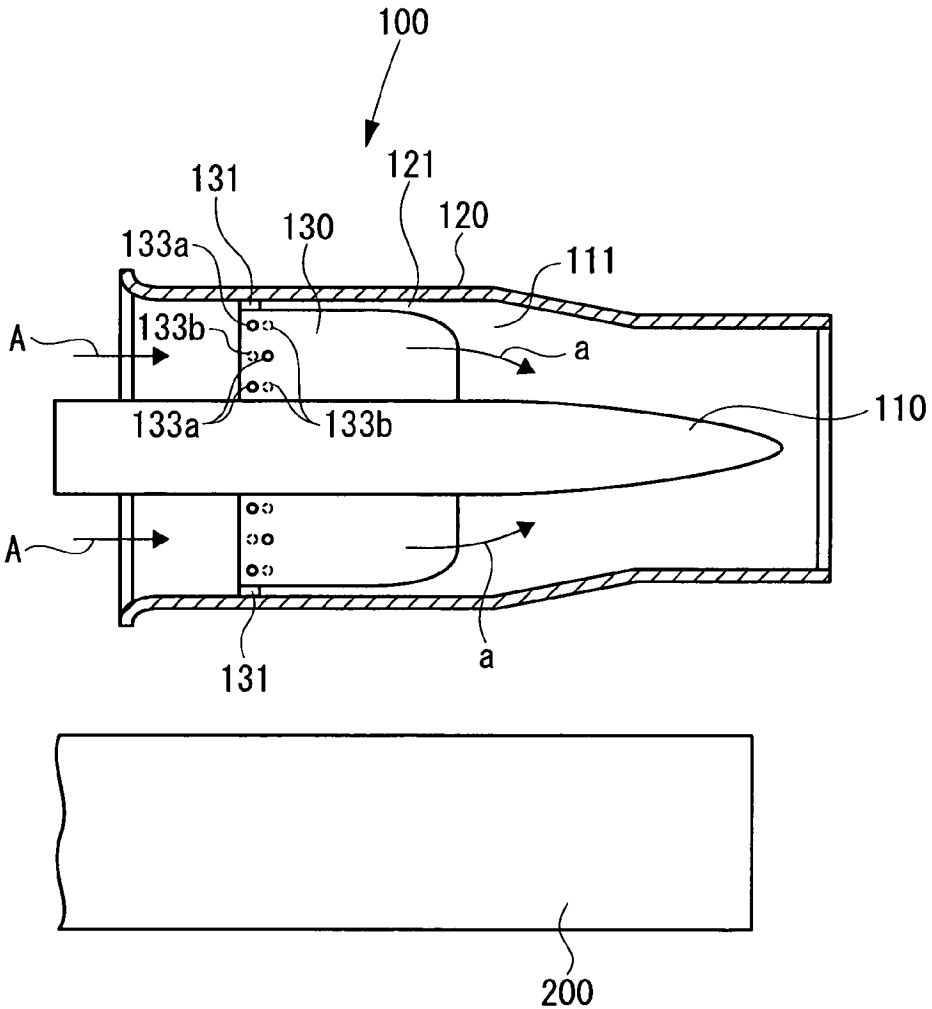
FIG. 1 is a configurational drawing showing a premixed combustion burner of a gas turbine according to Embodiment 1 of the present invention.

100 Premixed combustion burner
110 Fuel nozzle
111 Air passage
120 Burner tube
121 Clearance
130 Swirl tube
131 Clearance setting rib
132*a* Vane ventral surface
132*b* Vane dorsal surface
133*a*, 133*b* Injection hole
200 Pilot combustion burner A Compressed air
a Swirl air flow
u Vortex air flow

BEST MODE FOR CARRYING OUT THE INVENTION

Embodiments of the present invention will now be described in detail based on the Embodiments shown below.

Embodiment 1

A plurality of premixed combustion burners 100 of a gas turbine according to Embodiment 1 of the present invention are arranged to surround the periphery of a pilot combustion burner 200, as shown in FIG. 1. A pilot combustion nozzle, although not shown, is built into the pilot combustion burner 200.

The premixed combustion burners 100, and the pilot combustion burner 200 are arranged within the inner tube of the gas turbine.

The premixed combustion burner 100 is composed of a fuel nozzle 110, a burner tube 120, and a swirl vane (swirler vane) 130 as main members.

The burner tube 120 is disposed to be concentric with the fuel nozzle 110 and to encircle the fuel nozzle 110. Thus, a ring-shaped air passage 111 is formed between the outer peripheral surface of the fuel nozzle 110 and the inner peripheral surface of the burner tube 120.

Compressed air A flows through the air passage 111 from its upstream side (left-hand side in FIG. 1) toward its downstream side (right-hand side in FIG. 1).

Figure 2:
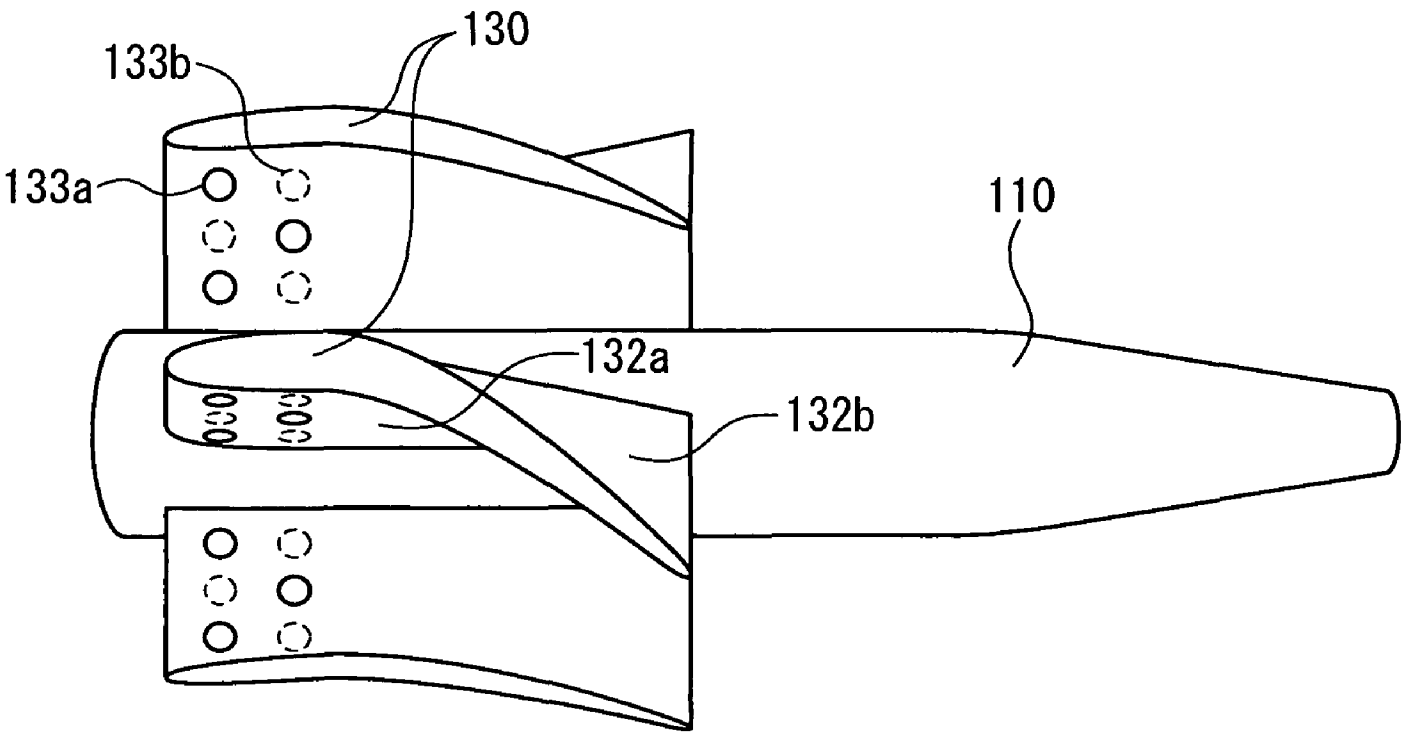
FIG. 2 is a perspective view showing a fuel nozzle and swirl vanes of the premixed combustion burner according to Embodiment 1.
Figure 3:
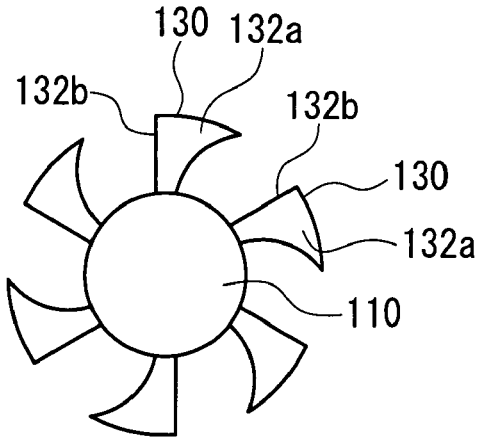
FIG. 3 is a configurational drawing showing, from an upstream side, the fuel nozzle and swirl vanes of the premixed combustion burner according to Embodiment 1.
Figure 4:
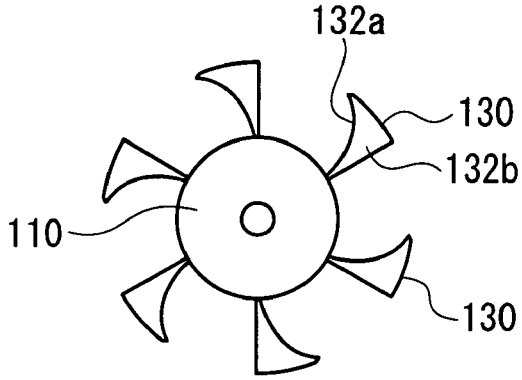
FIG. 4 is a configurational drawing showing, from a downstream side, the fuel nozzle and swirl vanes of the premixed combustion burner according to Embodiment 1.

As shown in FIG. 1, FIG. 2 as a perspective view, FIG. 3 viewed from the upstream side, and FIG. 4 viewed from the downstream side, the swirl vanes 130 are arranged at a plurality of locations (six locations in the present embodiment) along the circumferential direction of the fuel nozzle 110, and extend along the axial direction of the fuel nozzle 110.

In FIG. 1, only two of the swirl vanes 130 arranged at an angle of 0 degree and an angle of 180 degrees along the circumferential direction are shown to facilitate understanding (in the state of FIG. 1, a total of the four swirl vanes are seen actually).

Each swirl vane 130 is designed to impart a swirling force to the compressed air A flowing through the air passage 111, thereby converting the compressed air A into a swirl air flow a. For this purpose, each swirl vane 130 gradually curves from its upstream side toward its downstream side (inclines along the circumferential direction) so as to be capable of swirling the compressed air A. Details of the curved state of the swirl vane 130 will be described later.

A clearance (gap) 121 is provided between the outer peripheral side end surface (tip) of each swirl vane 130 and the inner peripheral surface of the burner tube 120.

Further, a clearance setting rib 131 is fixed to a front edge side of the outer peripheral side end surface (tip) of each swirl vane 130. Each clearance setting rib 131 has such a height (diametrical length) as to make intimate contact with the inner peripheral surface of the burner tube 120 when the fuel nozzle 110 equipped with the swirl vanes 130 is assembled to the interior of the burner tube 120.

Thus, the length (diametrical length) of each clearance 121 formed between each swirl vane 130 and the burner tube 120 is equal. Also, it becomes easy to perform an assembly operation for assembling the fuel nozzle 110 equipped with the swirl vanes 130 to the interior of the burner tube 120.

The relationship between the length of the clearance 121 and the vane height of the swirl vane 130 will be described later.

Injection holes 133*b* (indicated by dashed-line circles in FIGS. 1 and 2) are formed in the vane dorsal surface 132*b* of each swirl vane 130, and injection holes 133*a* (indicated by solid-line circles in FIGS. 1 and 2) are formed in the vane ventral surface 132*a* of each swirl vane 130. In this case, the positions of formation of the injection holes 133*b* and the injection holes 133*a* are in a staggered arrangement.

Thus, when the adjacent swirl vanes 131 are observed, the position of the injection hole 133*a* formed in the vane ventral surface 132*a* of one of the adjacent swirl vanes 131 and the position of the injection hole 133*b* formed in the vane dorsal surface 132*b* of the other of the adjacent swirl vanes 131 are displaced with respect to each other.

Fuel passages, although not shown, are formed within the fuel nozzle 110 and each swirl vane 130, and a fuel is supplied to the respective injection holes 133*a*, 133*b* via the fuel passages of the fuel nozzle 110 and the fuel passages of each swirl vane 130.

Thus, the fuel is injected through the respective injection holes 133*a*, 133*b* toward the air passage 111. At this time, the position of arrangement of the injection hole 133*a* and the position of arrangement of the injection hole 133*b* are displaced with respect to each other, so that the fuel injected through the injection hole 133*a* and the fuel injected through the injection hole 133*b* do not interfere (collide).

The injected fuel is mixed with the air A (a) to form a fuel gas, which is fed to the internal space of an inner tube for combustion.

Next, the curved state of the swirl vane 130 will be described with reference to FIGS. 1 to 4.

(1) Briefly, each swirl vane 130 progressively curves from its upstream side toward its downstream side so as to be capable of swirling the compressed air A.

(2) As far as the axial direction (longitudinal direction of the fuel nozzle 110) is concerned, the curvature increases farther from the upstream side and nearer to the downstream side.

(3) At the rear edge of the swirl vane 130, the curvature increases toward the outer peripheral side, as compared with the inner peripheral side, with respect to the diametrical direction (radial direction (direction of radiation) of the fuel nozzle 110).

The above-described curvature at the rear edge of the swirl vane 130 in (3) will be further described with reference to FIG. 5.

Figure 5:
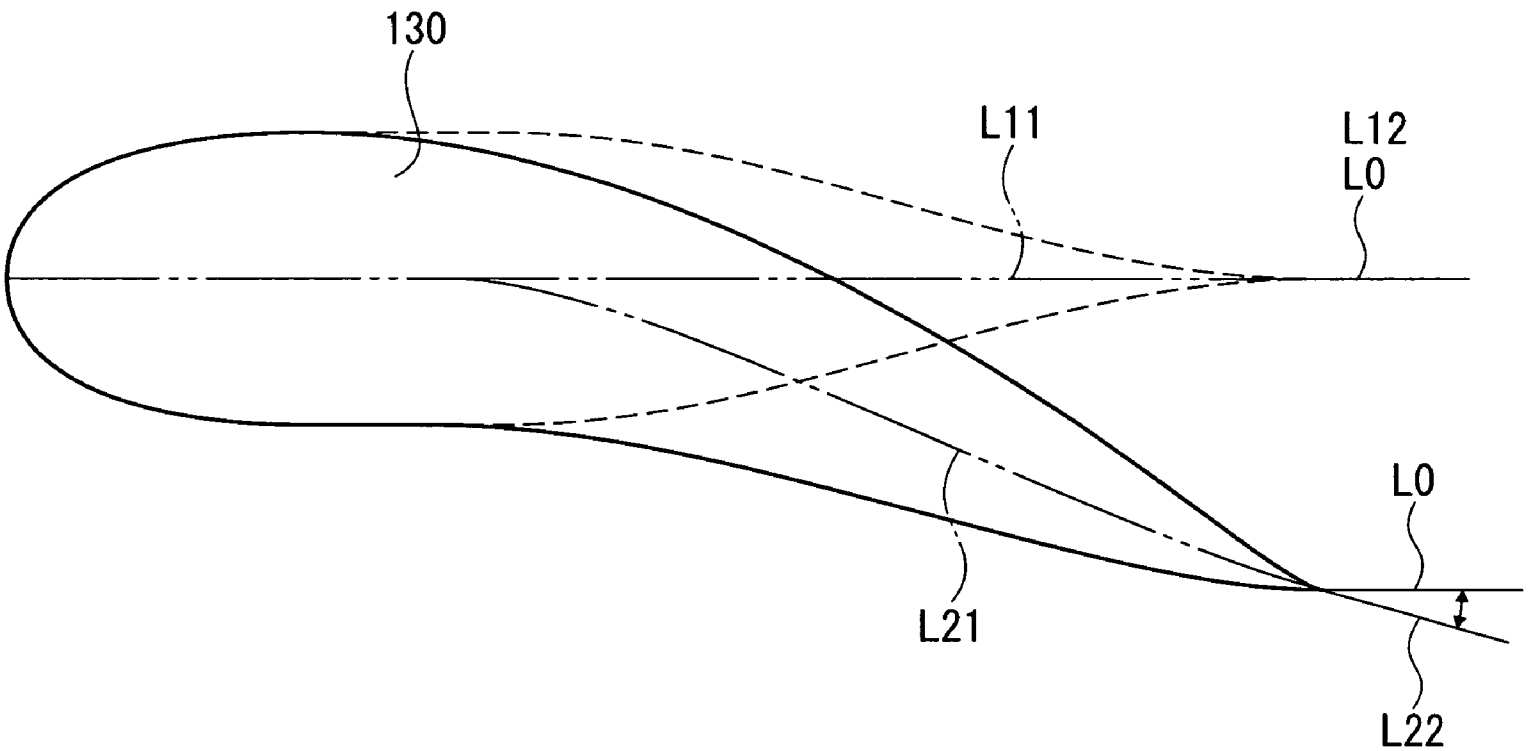
FIG. 5 is an explanation drawing showing the curved state of the swirl vane.

In FIG. 5, dashed lines represent the vane profile (vane sectional shape) on the inner peripheral side (innermost peripheral surface) of the swirl vane 130, while solid lines represent the vane profile (vane sectional shape) on the outer peripheral side (outermost peripheral surface) of the swirl vane 130.

In the vane profile on the inner peripheral side indicated by the dashed lines, an average camber line (skeletal line) is designated as L11, and a tangent to the average camber line L11 at the rear edge of the swirl vane is designated as L12.

In the vane profile on the outer peripheral side indicated by the solid lines, an average camber line (skeletal line) is designated as L21, and a tangent to the average camber line L21 at the rear edge of the swirl vane is designated as L22.

An axis line along the axial direction of the fuel nozzle 110 is designated as L0.

According to the present embodiment, as shown in FIG. 5, at the rear edge of the swirl vane 130, an angle formed by the tangent L12 on the inner peripheral side and the axis line L0 is set at 0 degree, and an angle formed by the tangent L22 on the outer peripheral side and the axis line L0 is set to be larger than the angle on the inner peripheral side.

According to studies by the inventor, when the angle formed by the axis line and the tangent to the average camber line at the rear edge of the swirl vane is increased from the inner peripheral side toward the outer peripheral side, it has been found "optimal"

(a) to set the angle on the inner peripheral side at 0 to 10 degrees, and (b) to set the angle on the outer peripheral side at 25 to 35 degrees.

Here, the term "optimal" means (i) that whether on the inner peripheral side or on the outer peripheral side of the air passage 111, the flow velocity of the air A (a) becomes uniform, and the occurrence of flashback (backfire) can be prevented, and (ii) that whether on the inner peripheral side or on the outer peripheral side of the air passage 111, the fuel concentration becomes uniform.

The reason for (i) will be described.

Assume that the angle formed by the tangent to the average camber line and the axis line on the inner peripheral side is set to be equal to that on the outer peripheral side. In this case, a streamline (air flow) heading from the inner peripheral side toward the outer peripheral side is generated. As a result, the flow velocity of the air A (a) passing on the inner peripheral side of the air passage 111 (passing along the axial direction) becomes low, while the flow velocity of the air A (a) passing on the outer peripheral side of the air passage 111 (passing along the axial direction) becomes high. If the air flow velocity on the inner peripheral side is decreased in this manner, flashback is likely to occur on the inner peripheral side.

In the present invention, however, the angle formed by the tangent to the average camber line and the axis line increases from the inner peripheral side toward the outer peripheral side. Thus, the occurrence of the streamline heading from the inner peripheral side toward the outer peripheral side can be suppressed. Whether on the inner peripheral side or on the outer peripheral side of the air passage 111, therefore, the flow velocity of the air A (a) becomes uniform, and can prevent the occurrence of flashback (backfire).

The reason for (ii) above will be described.

The circumferential length of the air passage 111 is short on the inner peripheral side, and long on the outer peripheral side. In the present invention, the angle formed by the tangent to the average camber line and the axis line increases from the inner peripheral side toward the outer peripheral side. Thus, the force (effect) imparting swirl to the compressed air A is stronger on the outer peripheral side with the larger circumferential length than on the inner peripheral side with the smaller circumferential length. As a result, the force imparting swirl to the compressed air A is uniform, per unit length, not only on the inner peripheral side but also on the outer peripheral side. Thus, the fuel concentration is uniform on the outer peripheral side as well as on the inner peripheral side.

Furthermore, the reason why the angle formed by the axis line and the tangent to the average camber line at the rear edge of the swirl vane is (a) set at 0 to 10 degrees as the angle on the inner peripheral side, and (b) set at 25 to 35 degrees as the angle on the outer peripheral side will be explained with reference to FIGS. 6 and 7 which are characteristic views showing the results of experiments. The "angles" shown in FIGS. 6 and 7 are angles formed by the axis line and the tangent to the average camber line at the rear edge of the swirl vane.

Figure 6:
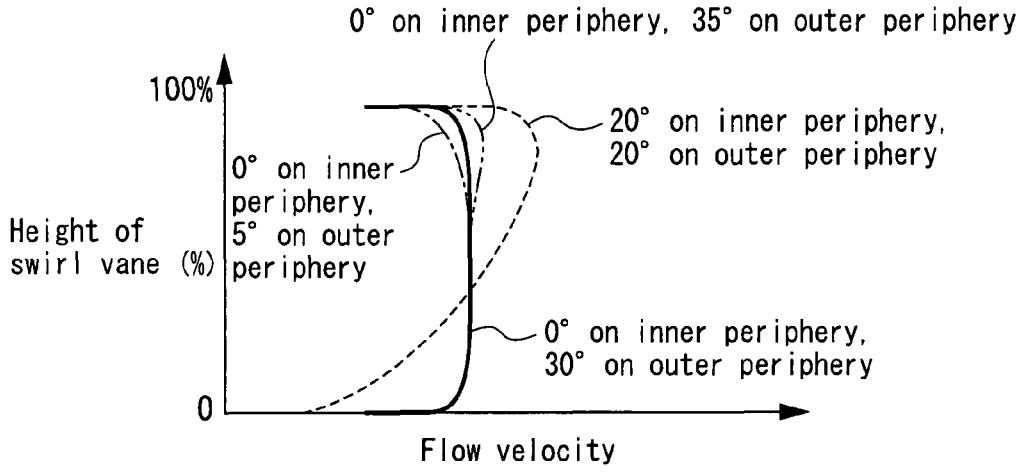
FIG. 6 is a characteristic view showing the relationship between the height of the swirl vane and the flow velocity of air.

FIG. 6 is a characteristic view in which the ordinate represents the height (%) of the swirl vane 130 and the abscissa represents the flow velocity of the air A (a). The height of the swirl vane of 100% means the outermost peripheral position of the swirl vane, and the height of the swirl vane of 0% means the innermost peripheral position of the swirl vane.

FIG. 6 shows a characteristic with the angle on the inner peripheral side of 0 degree and the angle on the outer peripheral side of 5 degrees, a characteristic with the angle on the inner peripheral side of 0 degree and the angle on the outer peripheral side of 30 degrees, a characteristic with the angle on the inner peripheral side of 0 degree and the angle on the outer peripheral side of 35 degrees, and a characteristic with the angle on the inner peripheral side of 20 degrees and the angle on the outer peripheral side of 20 degrees.

Figure 7:
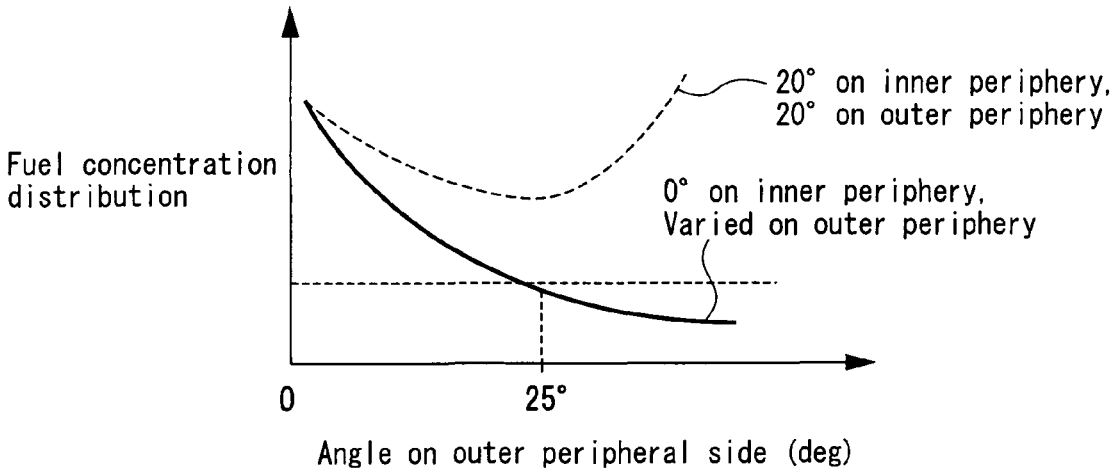
FIG. 7 is a characteristic view showing the relationship between the fuel concentration distribution and the angle on the outer peripheral side of the swirl vane.

FIG. 7 is a characteristic view in which the fuel concentration distribution is plotted as the ordinate and the angle on the outer peripheral side is plotted as the abscissa. The fuel concentration distribution refers to the difference between the maximum fuel concentration and the minimum fuel concentration, and a smaller value of the fuel concentration distribution means that the concentration is constant.

FIG. 7 shows a characteristic with the angle on the inner peripheral side of 20 degrees and the angle on the outer peripheral side of 20 degrees, and a characteristic with the angle on the inner peripheral side of 0 degree and the angle on the outer peripheral side of varying degree.

As seen from FIG. 7 showing the fuel concentration distribution, the fuel concentration becomes uniform when the angle on the outer peripheral side becomes 25 degrees or more.

As seen from FIG. 6, moreover, it is at the angle on the inner peripheral side of 0 to 10 degrees and at the angle on the outer peripheral side of 25 to 35 degrees that the distribution, in the vane height direction, of the flow velocity is uniformized at the angle on the outer peripheral side of 25 degrees or more.

As note above, the characteristics in FIGS. 6 and 7 show that (a) by setting the angle on the inner peripheral side at 0 to 10 degrees, and (b) by setting the angle on the outer peripheral side at 25 to 35 degrees, (i) whether on the inner peripheral side or on the outer peripheral side of the air passage 111, the flow velocity of the air A (a) becomes uniform, and can prevent the occurrence of flashback (backfire), and (ii) whether on the inner peripheral side or on the outer peripheral side of the air passage 111, the fuel concentration can be uniformized.

In the present embodiment, as stated above, the clearance (gap) 121 is intentionally provided between the outer peripheral side end surface (tip) of each swirl vane 130 and the inner peripheral surface of the burner tube 120.

The vane dorsal surface 132*b* of the swirl vane 130 is under negative pressure, while the vane ventral surface 132*a* of the swirl vane 130 is under positive pressure, so that there is a pressure difference between the vane dorsal surface 132*b* and the vane ventral surface 132*a*. Thus, a leakage flow of air is produced which passes through the clearance 121 and goes around from the vane ventral surface 132*a* to the vane dorsal surface 132*b*. This leakage flow, and the compressed air A flowing through the air passage 111 in the axial direction act to produce a vortex air flow. This vortex air flow mixes the fuel injected through the injection holes 133*a*, 133*b* and air more effectively, thereby promoting the uniformization of the fuel gas.

In the present embodiment, the ratio between the vane height of the swirl vane 130 and the length of the clearance 121 (clearance length/vane height) is set at 1 to 10%. By so doing, the uniformization of the concentration distribution of the fuel can be promoted, without an increase in the pressure loss.

The reason why the uniformization of the concentration distribution of the fuel can be promoted, without an increase in the pressure loss, by setting the ratio (clearance length/vane height) at 1 to 10% will be described with reference to FIGS. 8(*a*), 8(*b*) which show the results of experiments.

Figure 8A:
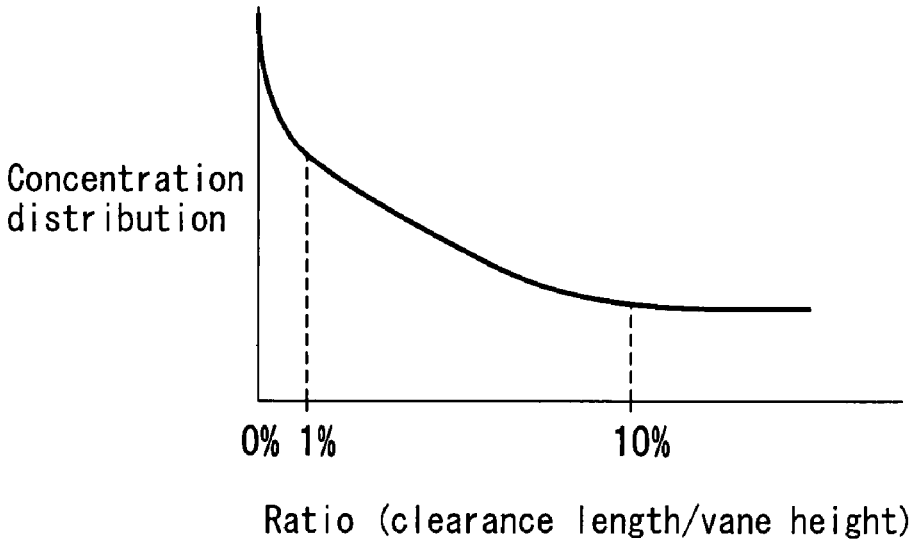
FIGS. 8(*a*), 8(*b*) FIG. 8(*a*) is a characteristic view showing the relationship between the concentration distribution and the ratio (clearance length/vane length).
Figure 8B:
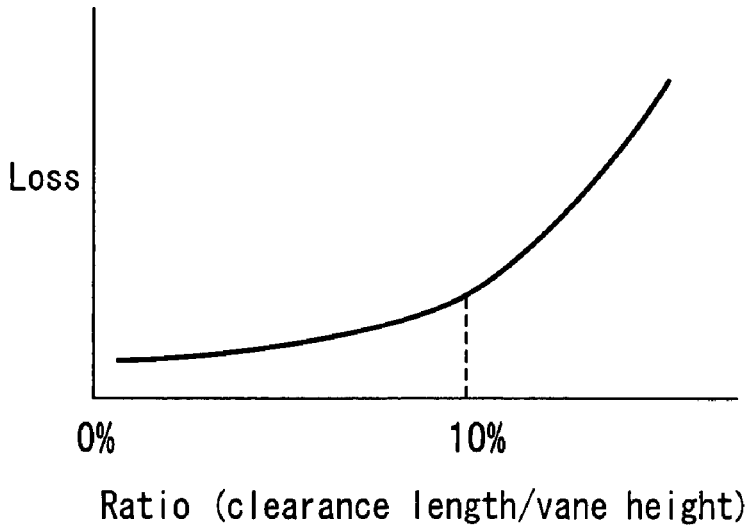
Figure 9A:
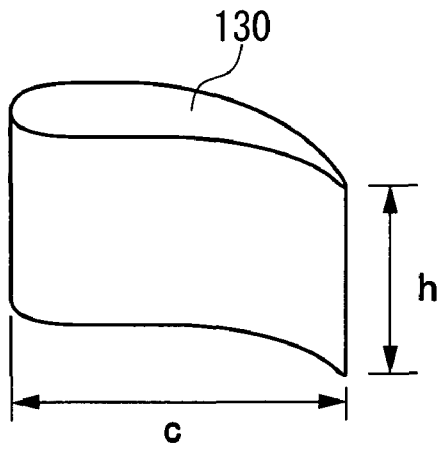
FIGS. 9(*a*) to 9(*d*) are explanation drawings showing the relationships between the swirl vanes having different aspect ratios and vortex air flows.
Figure 9B:
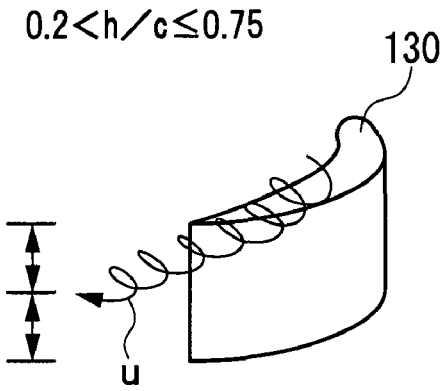
Figure 9C:
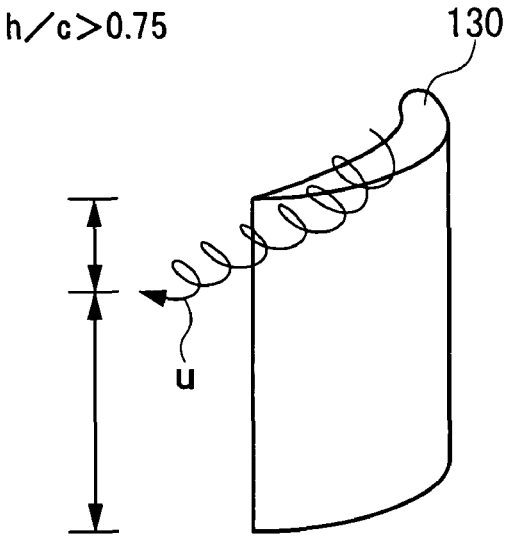
Figure 9D:
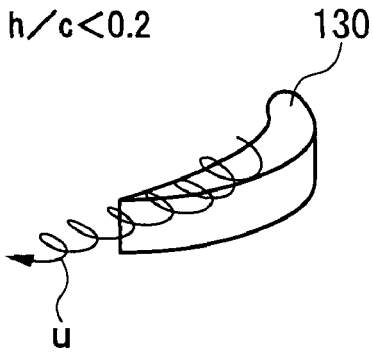

FIG. 8(*a*) is a characteristic view in which the fuel concentration distribution is plotted as the ordinate and the ratio (clearance length/vane height) is plotted as the abscissa. The fuel concentration distribution refers to the difference between the maximum fuel concentration and the minimum fuel concentration, and a smaller value of the fuel concentration distribution means that the concentration is constant.

FIG. 8(*b*) is a characteristic view in which the loss is plotted as the ordinate and the ratio (clearance length/vane height) is plotted as the abscissa.

As seen from FIGS. 8(*a*), 8(*b*), when the ratio (clearance length/vane height) is less than 1%, the effect of mixing the fuel and air is insufficient, a fine clearance results, and the influence of the assembly error is great. When the ratio (clearance length/vane height) exceeds 10%, on the other hand, a heavy loss results, and it becomes difficult to control a flow by the cascade of the vanes.

After all, it is recommendable that the ratio (clearance length/vane height) be 1 to 10%, in order to promote mixing by the vortex air flow, while controlling the flow, without increasing the pressure loss, thereby uniformizing the concentration distribution of the fuel.

Ideally, the ratio (clearance length/vane height) should be 7 to 10%.

In the present embodiment, moreover, an aspect ratio between the vane chord length (chord length) c and the vane height h of the swirl vane 130 (vane height h/vane chord length c) is set at 0.2 to 0.75 (see FIG. 9(*a*)).

In the present embodiment, as stated earlier, the leakage flow of air, which passes through the clearance 121 and goes around from the vane dorsal surface 132*b* to the vane ventral surface 132*a*, and the compressed air A flowing in the axial direction act to produce the vortex air flow u.

When the aspect ratio h/c is set at 0.2 to 0.75, the region of mixing by the vortex air flow u corresponds to 50% or more of the vane height h, as shown in FIG. 9(*b*). As a result, the mixing of the fuel and air is performed satisfactorily.

An aspect ratio h/c of about 0.5 is optimal.

If the aspect ratio h/c is higher than 0.75, the region of mixing by the vortex air flow u corresponds to less than 50% of the vane height h, as shown in FIG. 9(*c*). As a result, the efficiency of mixing of the fuel and air lowers. Moreover, the chord length c is too small to provide room for creating the internal structure (fuel passages, etc.) of the swirl vane 130.

If the aspect ratio h/c is lower than 0.2, as shown in FIG. 9(*d*), the air loss increases, and the efficiency of mixing by the vortex air flow u is low. Moreover, a region which the secondary flow (vortex air flow u) occupies in the main flow becomes so large that control of the flow is difficult.

After all, in order to mix the injected fuel and air by the vortex air flow u, thereby promoting the uniformization of the fuel gas, and ensure a sufficient space for the internal structure, thereby controlling the flow, it is advisable to set the aspect ratio h/c at 0.2 to 0.75.

In the present embodiment, moreover, the vane thickness of the swirl vane 130 is set at 0.1 to 0.3 times the vane chord length c of the swirl vane 130. By so doing, the pressure loss can be decreased, with ample fuel passages being ensured within the vane.

If the vane thickness of the swirl vane 130 is smaller than a length which is 0.1 times the vane chord length c of the swirl vane 130, adequate fuel passages cannot be secured within the swirl vane 130. Thus, a pressure loss for fuel supply is increased, and the amount of fuel blowoff becomes nonuniform.

Conversely, if the vane thickness of the swirl vane 130 is larger than a length which is 0.3 times the vane chord length c of the swirl vane 130, the vane surface boundary layer of the swirl vane 130 thickens, causing a great pressure loss of air. Depending on conditions, the air flow separates from the vane surface.

Furthermore, according to the present embodiment, the thickness of the vane at the rear edge of the swirl vane 130 is rendered smaller than a length which is 0.2 times the throat length.

As noted above, the thickness of the vane at the rear edge of the swirl vane 130 is rendered small, thus resulting in a thin shallow wake. Hence, the occurrence of flashback can be prevented.

Embodiment 2

In the above-described Embodiment 1, the swirl vane 130 is configured, as shown in FIG. 2, such that the angle formed by the tangent to the average camber line of the swirl vane 130 at the rear edge of the swirl vane 130 and the axis line extending along the axial direction of the fuel nozzle 100 is 0 to 10 degrees on the inner peripheral side of the rear edge of the swirl vane 130, and is 25 to 35 degrees on the outer peripheral side of the rear edge of the swirl vane 130.

Figure 10:
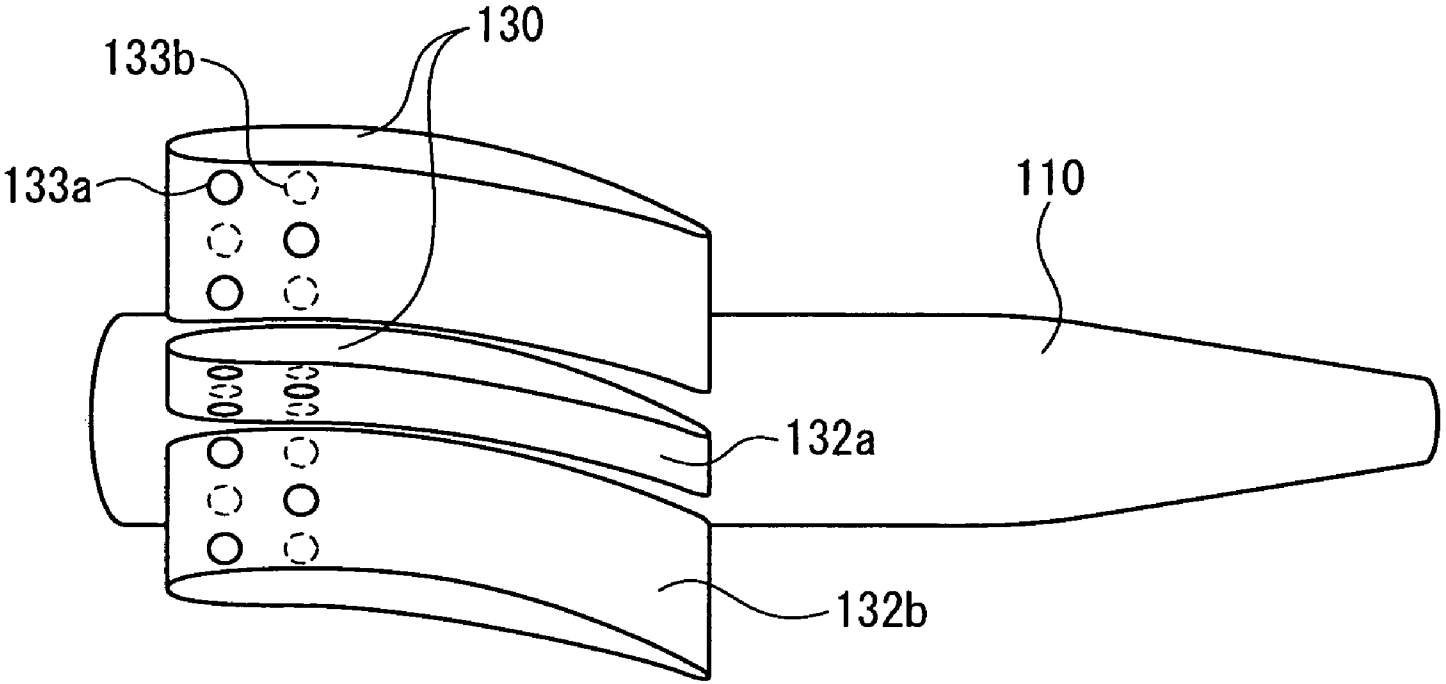
FIG. 10 is a perspective view showing a fuel nozzle and swirl vanes of a premixed combustion burner according to Embodiment 2.
Figure 11:
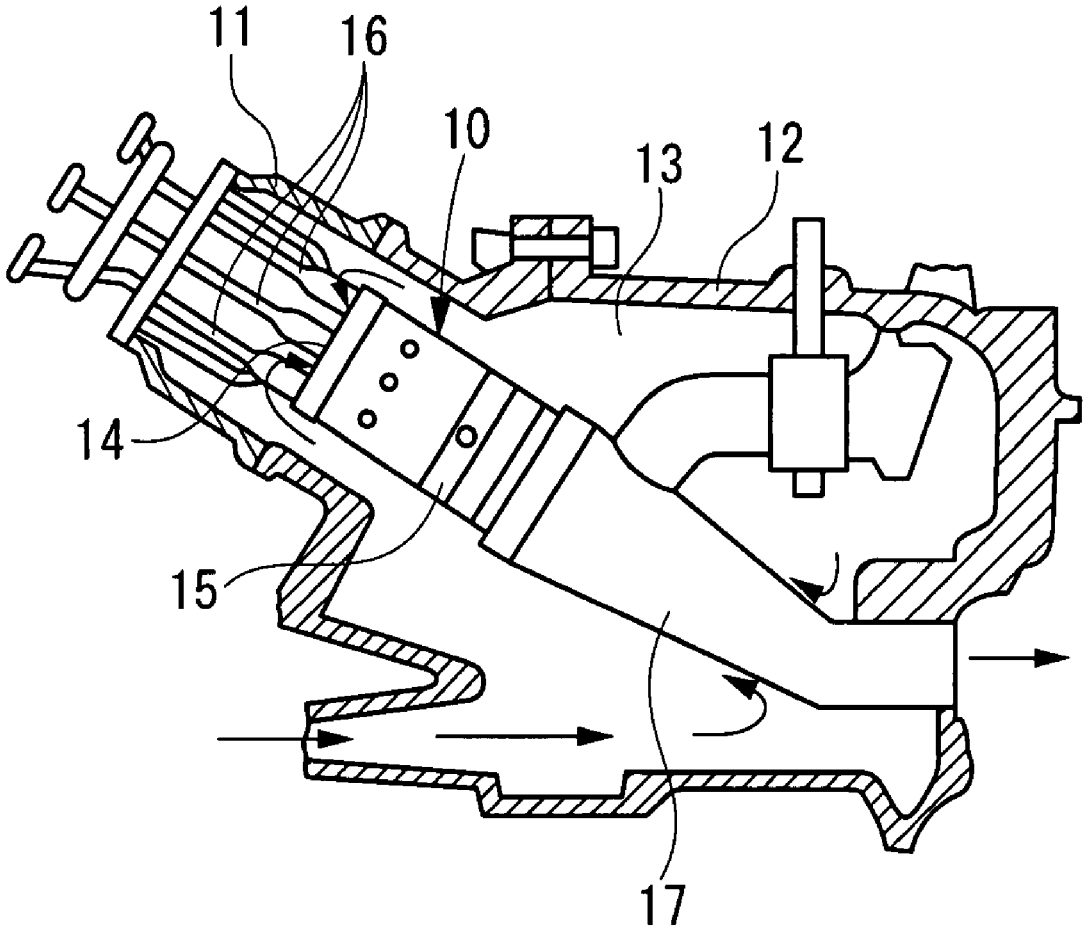
FIG. 11 is a configurational drawing showing a combustor of a conventional gas turbine.
Figure 12:
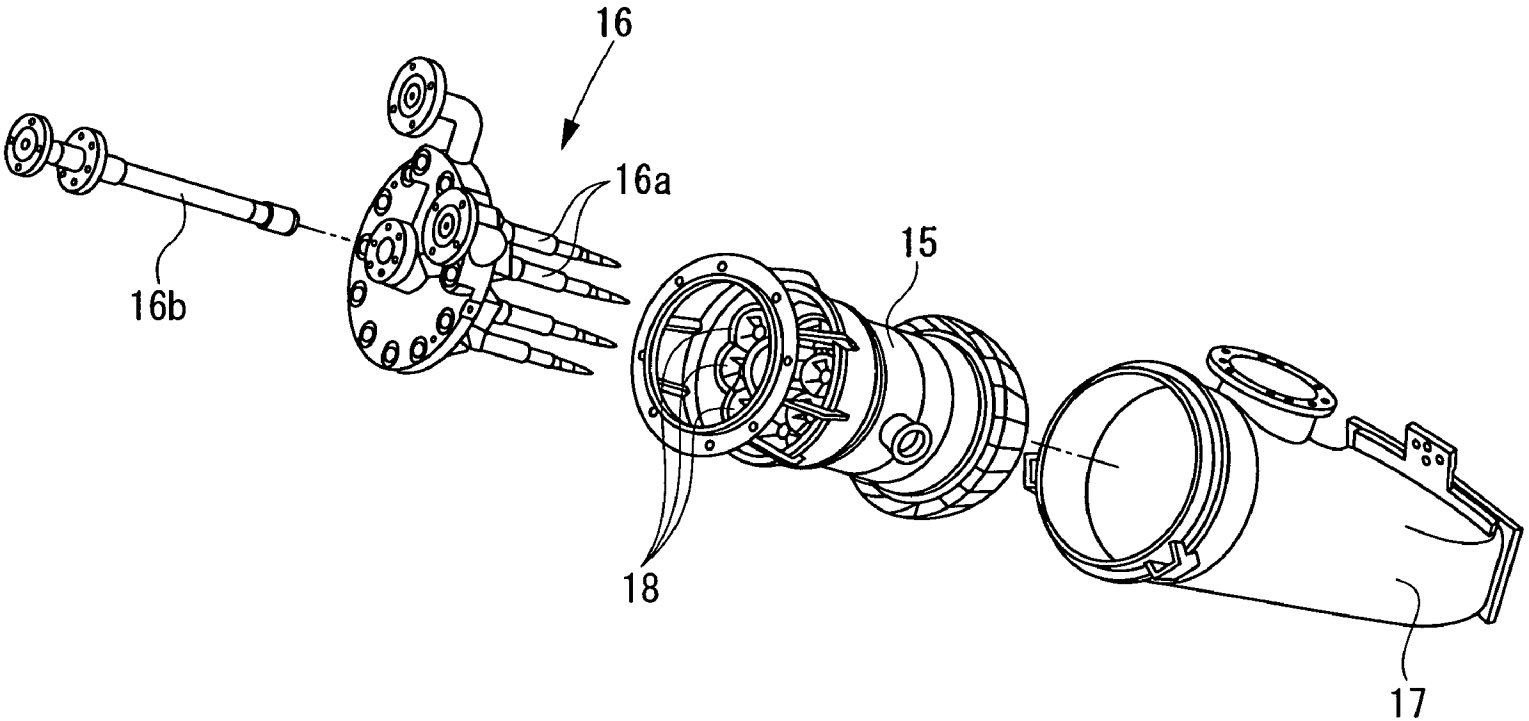
FIG. 12 is a perspective view showing a fuel nozzle, an inner tube, and a transition pipe of the combustor of the conventional gas turbine in an exploded state.

In Embodiment 2, there is adopted the swirl vane 130 configured, as shown in FIG. 10, such that the angle formed by the tangent to the average camber line of the swirl vane 130 at the rear edge of the swirl vane 130 and the axis line extending along the axial direction of the fuel nozzle 110 is rendered the same for the inner peripheral side and the outer peripheral side of the rear edge of the swirl vane 130.

The swirl vanes 130, in each of which the angle formed by the tangent to the average camber line of the swirl vane 130 at the rear edge of the swirl vane 130 and the axis line extending along the axial direction of the fuel nozzle 110 is rendered the same for the inner peripheral side and the outer peripheral side of the rear edge of the swirl vane 130, are provided on the outer peripheral surface of the fuel nozzle 110, and this composite is assembled to the interior of the burner tube 120 in the same mode as that in FIG. 1. The resulting premixed combustion burner is Embodiment 2.

Other features are the same as those in Embodiment 1, and the same effects as those in Embodiment 1 can be obtained.

That is, in Embodiment 2 as well, the ratio between the vane height of the swirl vane 130 and the length of the clearance (clearance length/vane height) is set at 1 to 10%, the clearance setting rib 131, which makes intimate contact with the inner peripheral surface of the burner tube 120, is provided at a portion of the outer peripheral side end surface of the swirl vane 130, the aspect ratio between the vane chord length and the vane height of the swirl vane 130 (vane height/vane chord length) is set at 0.2 to 0.75, the vane thickness of the swirl vane 130 is set to be a length which is 0.1 to 0.3 times the vane chord length of the swirl vane 130, the vane thickness at the rear edge of the swirl vane 130 is smaller than 0.2 times the throat length, and the injection holes 133*a* and the injection holes 133*b* can be formed at displaced positions in the swirl vane 130.

The features of Embodiment 2 are the same as the features of Embodiment 1, except that the angle formed by the tangent to the average camber line of the swirl vane 130 at the rear edge of the swirl vane 130 and the axis line extending along the axial direction of the fuel nozzle 110 is rendered the same for the inner peripheral side and the outer peripheral side of the rear edge of the swirl vane 130. These same features and portions as those in Embodiment 1 can obtain the same effects as those in Embodiment 1.

The invention claimed is:

1. A premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and the angle is larger on an outer peripheral side of the rear edge of the swirl vane than the angle on the inner peripheral side of the rear edge of the swirl vane, and a clearance is provided between an outer peripheral side end surface of the swirl vane and an inner peripheral surface of the burner tube, wherein in order to render said clearance between said outer peripheral side end surface of the swirl vane and said inner peripheral surface of the burner tube constant, a clearance setting rib, which makes intimate contact with the inner peripheral surface of the burner tube, is provided at a portion of the outer peripheral side end surface of the swirl vane.

2. A premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, characterized in that an angle formed by a tangent to an average camber line of the swirl vane at a rear edge of the swirl vane and an axis line extending along the axial direction of the fuel nozzle is 0 to 10 degrees on an inner peripheral side of the rear edge of the swirl vane, and is 25 to 35 degrees on an outer peripheral side of the rear edge of the swirl vane, and a clearance is provided between an outer peripheral side end surface of the swirl vane and an inner peripheral surface of the burner tube, wherein in order to render said clearance between said outer peripheral side end surface of the swirl vane and said inner peripheral surface of the burner tube constant, a clearance setting rib, which makes intimate contact with the inner peripheral surface of the burner tube, is provided at a portion of the outer peripheral side end surface of the swirl vane.

3. The premixed combustion burner of a gas turbine according to claim 1 or 2, characterized in that an aspect ratio between a vane chord length and the vane height of the swirl vane (vane height/vane chord length) is set at 0.2 to 0.75.

4. The premixed combustion burner of a gas turbine according to claim 1 or 2, characterized in that a vane thickness of the swirl vane is a length which is 0.1 to 0.3 times a vane chord length of the swirl vane.

5. The premixed combustion burner of a gas turbine according to claim 1 or 2, characterized in that a vane thickness at the rear edge of the swirl vane is smaller than 0.2 times a throat length.

6. The premixed combustion burner of a gas turbine according to claim 1 or 2, characterized in that fuel injection holes for injecting a fuel supplied from the fuel nozzle through fuel passages are formed in the swirl vane, and the fuel injection holes formed in opposed vane surfaces of the adjacent swirl vanes are positioned such that positions of the fuel injection holes formed in one of the vane surfaces, and positions of the fuel injection holes formed in the other vane surface are displaced with respect to each other.

7. The premixed combustion burner of a gas turbine according to claim 1 or 2, wherein:

a ratio between a vane height of the swirl vane and a length of the clearance (clearance length/vane height) is set at 1 to 10%.

8. A premixed combustion burner of a gas turbine, the premixed combustion burner comprising:

a fuel nozzle;

a burner tube disposed to encircle the fuel nozzle for forming an air passage between the burner tube and the fuel nozzle; and swirl vanes which are arranged at a plurality of locations along a circumferential direction of an outer peripheral surface of the fuel nozzle in such a state as to extend along an axial direction of the fuel nozzle, and which progressively curve from an upstream side toward a downstream side for swirling air flowing through the air passage from the upstream side toward the downstream side, and a clearance is provided between an outer peripheral side end surface of the swirl vane and an inner peripheral surface of the burner tube, wherein in order to render the clearance between the outer peripheral side end surface of the swirl vane and the inner peripheral surface of the burner tube constant, a clearance setting rib, which makes intimate contact with the inner peripheral surface of the burner tube, is provided at a portion of the outer peripheral side end surface of the swirl vane.

9. The premixed combustion burner of a gas turbine according to claim 8, characterized in that a ratio between a vane height of the swirl vane and a length of the clearance (clearance length/vane height) is set at 1 to 10%.

10. The premixed combustion burner of a gas turbine according to claim 8 or 9, characterized in that an aspect ratio between a vane chord length and the vane height of the swirl vane (vane height/vane chord length) is set at 0.2 to 0.75.

11. The premixed combustion burner of a gas turbine according to claim 8 or 9, characterized in that a vane thickness of the swirl vane is a length which is 0.1 to 0.3 times a vane chord length of the swirl vane.

12. The premixed combustion burner of a gas turbine according to claim 8 or 9, characterized in that a vane thickness at a rear edge of the swirl vane is smaller than 0.2 times a throat length.

13. The premixed combustion burner of a gas turbine according to claim 8 or 9, characterized in that fuel injection holes for injecting a fuel supplied from the fuel nozzle through fuel passages are formed in the swirl vane, and the fuel injection holes formed in opposed vane surfaces of the adjacent swirl vanes are positioned such that positions of the fuel injection holes formed in one of the vane surfaces, and positions of the fuel injection holes formed in the other vane surface are displaced with respect to each other.

* * * * *